US006959901B2

(12) United States Patent
Chang

(10) Patent No.: US 6,959,901 B2
(45) Date of Patent: Nov. 1, 2005

(54) ROTATABLE BOOK OR FILE HOLDER DEVICE

(76) Inventor: Chun Yuan Chang, P.O. Box 63-99, Taichung (TW) 406

( * ) Notice: Subject to any disclaimer, the term of this patent is extended or adjusted under 35 U.S.C. 154(b) by 51 days.

(21) Appl. No.: 10/730,316

(22) Filed: Dec. 4, 2003

(65) Prior Publication Data

US 2005/0121587 A1 Jun. 9, 2005

(51) Int. Cl.[7] ..... A47B 97/04

(52) U.S. Cl. ..... 248/458; 248/131; 248/415; 211/165; 211/169; 40/379; 40/497

(58) Field of Search ..... 248/458, 131, 248/415, 126, 441.1; 211/165, 169, 168, 211/47, 48; 40/379, 497, 124, 124.4

(56) References Cited

U.S. PATENT DOCUMENTS

| | | | | | |
|---|---|---|---|---|---|
| 888,158 | A | * | 5/1908 | Glass | 248/458 |
| 1,049,886 | A | * | 1/1913 | Manson | 40/497 |
| 1,436,544 | A | * | 11/1922 | Starr | 40/747 |
| 1,695,322 | A | * | 12/1928 | Day | 40/379 |
| 1,740,118 | A | * | 12/1929 | Rand | 40/379 |
| 1,766,940 | A | * | 6/1930 | Powell | 40/379 |
| 1,789,838 | A | * | 1/1931 | Powell | 40/379 |
| 1,789,839 | A | * | 1/1931 | Powell | 40/379 |
| 1,930,843 | A | * | 10/1933 | Pettis | 40/379 |
| 2,220,189 | A | * | 11/1940 | Wolters | 40/379 |
| 2,716,410 | A | * | 8/1955 | O'Hara | 40/379 |
| 4,102,069 | A | * | 7/1978 | Eckert | 40/497 |
| 4,370,821 | A | * | 2/1983 | Eichner | 40/497 |
| 4,412,621 | A | * | 11/1983 | Eichner | 211/58 |
| 4,946,127 | A | * | 8/1990 | Kulaga | 248/551 |
| 5,335,796 | A | * | 8/1994 | Sanford et al. | 211/45 |
| 6,000,561 | A | * | 12/1999 | Schumacher | 211/165 |

* cited by examiner

*Primary Examiner*—Anita King
*Assistant Examiner*—Naschica S. Morrison
(74) *Attorney, Agent, or Firm*—Alan D. Kamrath; Nikolai & Mersereau, P.A.

(57) ABSTRACT

A rotatable book holder includes a housing having a chamber to rotatably receive a rotary member which has a number of holes. A pole includes a lower portion secured to the rotary member, and a plate is secured to an upper portion of the pole and includes a number of holes facing toward the holes of the rotary member, to receive shanks of books, and for allowing the books to be rotated relative to the housing in concert with the rotary member, and thus for allowing the books to be easily viewed or read by the users. The housing includes a weight to rotatably support the pole and to increase stability of the housing.

8 Claims, 3 Drawing Sheets

ROTATABLE BOOK OR FILE HOLDER DEVICE

BACKGROUND OF THE INVENTION

1. Field of the Invention

The present invention relates to a book or file holder device, and more particularly to a rotatable book holder device having a rotatable support to rotatably support books and/or files therein.

2. Description of the Prior Art

Various kinds of typical book or file holders have been developed to hold various amount of books or files therein.

However, the typical book holders are normally stably supported on desks or the like for supporting the books or the files which may not be easily viewed or read by users.

The present invention has arisen to mitigate and/or obviate the afore-described disadvantages of the conventional book holders.

SUMMARY OF THE INVENTION

The primary objective of the present invention is to provide a rotatable book holder including a rotatable support to rotatably support books and/or files therein, and for allowing the users to easily view or read the books or the files.

In accordance with one aspect of the invention, there is provided a book holder comprising a housing including a chamber formed therein, a rotary member rotatably received in the chamber of the housing, and including a plurality of holes formed therein, a pole including a lower portion secured to the rotary member, and including an upper portion, and a plate secured to the upper portion of the pole, and including a plurality of holes formed therein and facing toward the holes of the rotary member, for receiving shanks of books, and for allowing the books to be rotated relative to the housing in concert with the rotary member, and thus for allowing the books to be easily viewed or read by the users.

The housing includes a weight disposed therein, to rotatably receive and support the lower portion of the pole. The weight includes a space formed therein to rotatably receive the lower portion of the pole, and a bearing received in the space of the weight and engaged onto the lower portion of the pole, to rotatably attach the pole to the weight. The housing includes a bottom board, the weight is secured on the bottom board.

The rotary member includes a noncircular center aperture formed therein, the pole includes a noncircular segment provided in the lower portion thereof and engaged in the noncircular aperture of the rotary member, to allow the pole to be rotated in concert with the rotary member.

The rotary member includes a space formed therein and communicating with the aperture thereof, to receive the lower portion of the pole, and a fastener received in the space of the rotary member and threaded with the lower portion of the pole, to solidly secure the lower portion of the pole to the rotary member.

The housing includes an opening formed therein and defined by a peripheral flange, the rotary member includes a bulge extended upwardly therefrom to form a peripheral shoulder therein and to rotatably receive the peripheral flange of the housing, and to rotatably and stably secure the rotary member in the chamber of the housing.

The plate includes a noncircular center aperture formed therein, the pole includes a noncircular segment provided in the upper portion thereof and engaged in the noncircular aperture of the plate, to allow the plate to be rotated in concert with the pole.

The pole includes a threaded portion provided on the upper portion thereof, and a fastener threaded to the threaded portion of the pole and engaged with the plate, to secure the plate to the pole.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
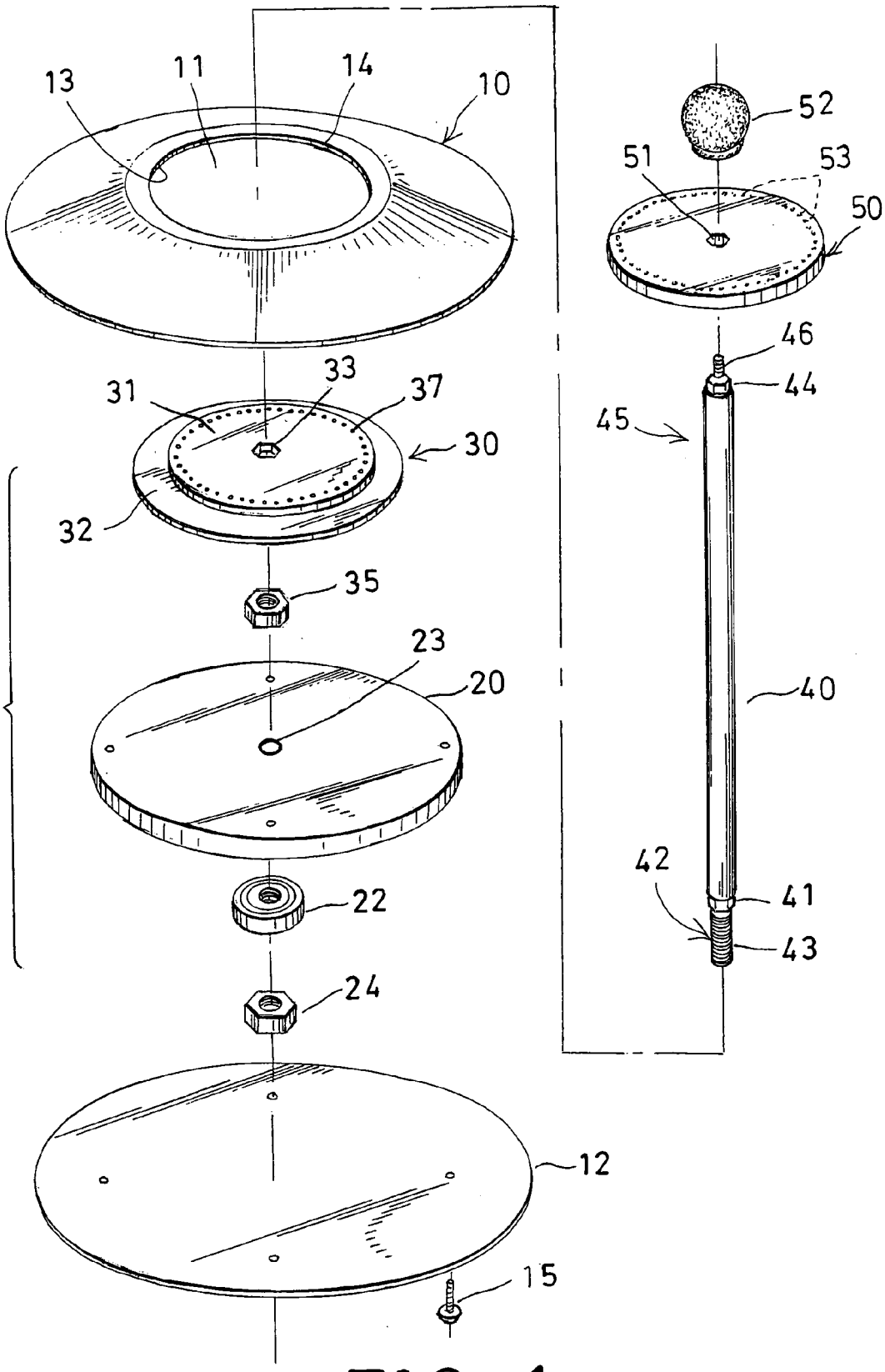
FIG. 1 is an exploded view of a rotatable book holder in accordance with the present invention.

Referring to the drawings, a rotatable book holder in accordance with the present invention comprises a housing 10 including a chamber 11 formed therein, and including a bottom board 12 secured to the bottom thereof with such as adhesive materials, fasteners (not shown), or by welding processes, or the like, and including an opening 13 formed in the upper portion thereof and defined by a peripheral flange 14.

Figure 3:
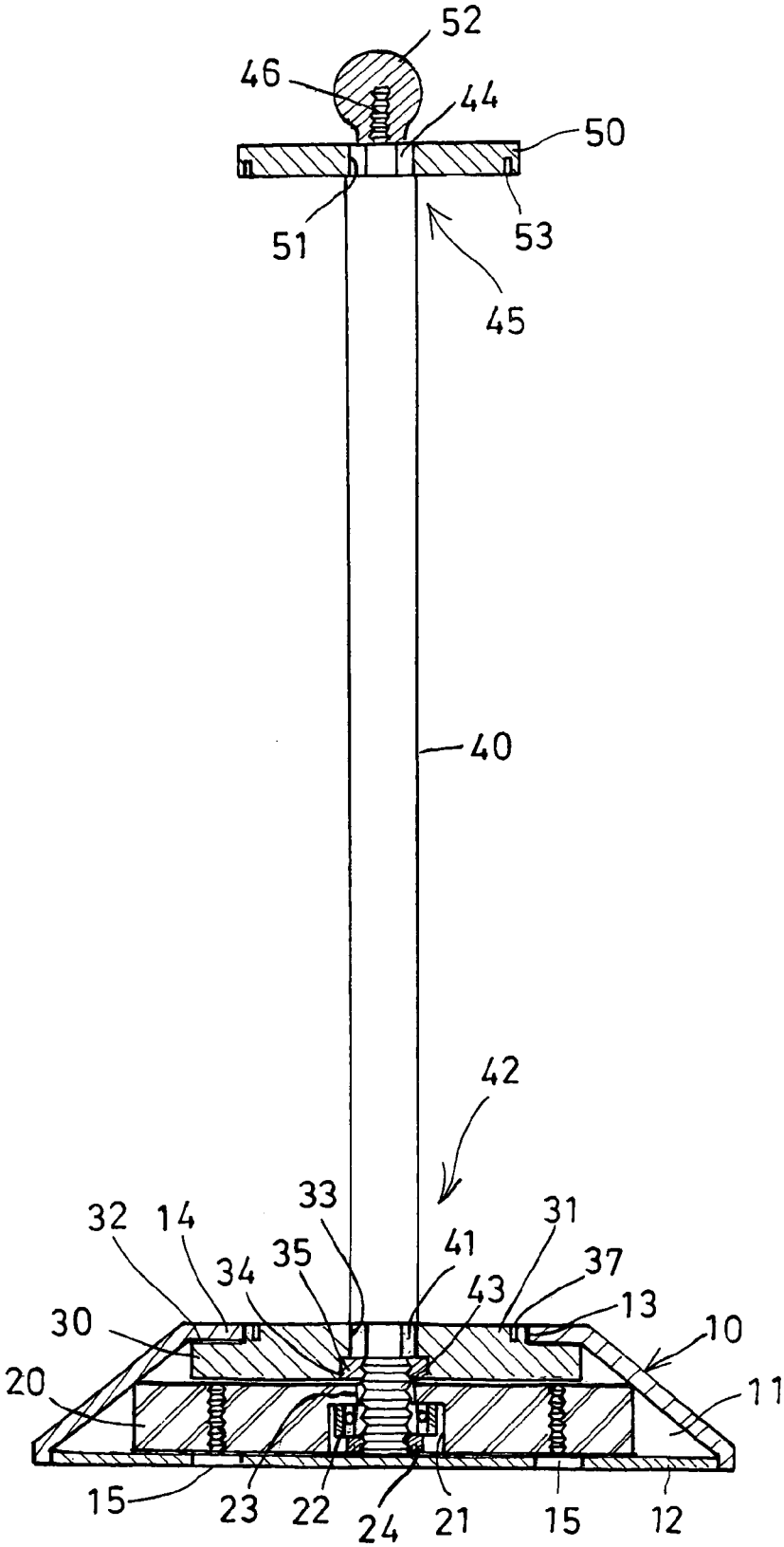
FIG. 3 is a cross sectional view taken along lines 3—3 of FIG. 2.

A weight 20 is received in the chamber 11 of the housing 10, and secured on top of the board 12 with such as fasteners 15, in order to increase a stability of the housing 10. The weight 20 may also be formed integral with the board 12 with such as molding or mold injection processes, and may thus be taken as one member of the housing 10. The weight 20 includes a space 21 formed in the lower portion thereof (FIG. 3), for rotatably receiving a bearing 22 therein, and includes an orifice 23 formed in the upper portion thereof and communicating with the space 21 thereof.

A rotary member 30 is rotatably received in the chamber 11 of the housing 10, and includes a bulge 31 extended upwardly therefrom to form or define a peripheral shoulder 32 therein and to rotatably receive the peripheral flange 14 of the housing 10, such that the rotary member 30 may be rotatably and stably received and retained in the chamber 11 of the housing 10. The bulge 31 of the rotary member 30 may be rotatably engaged in the opening 13 of the housing 10.

The rotary member 30 includes a center aperture 33 formed in the upper portion thereof and having a noncircular cross section, and includes a space 34 formed in the lower portion thereof and communicating with the aperture 33 thereof, for receiving a nut or fastener 35 therein. The rotary member 30 further includes a number of holes 37 formed in the upper portion thereof, or formed in the outer peripheral portion of the bulge 31 thereof.

A pole 40 includes a noncircular segment 41 formed or provided in the lower portion 42 thereof, and engaged in the noncircular aperture 33 of the rotary member 30, to allow the pole 40 to be rotated in concert with the rotary member 30. The pole 40 includes a bolt or a threaded portion 43 formed or provided in the lower portion 42 thereof, and threaded with the fastener 35, in order to solidly secure the pole 40 to the rotary member 30.

The lower portion 42 or the threaded portion 43 of the pole 40 is rotatably engaged through the orifice 23 of the weight 20, and engaged through the bearing 22 and secured to the bearing 22 with such as a fastener 24, such that the pole 40 may be rotatably attached or secured to the weight 20 with the bearing 22 which may facilitate the rotational movement of the pole 40 and the rotary member 30 relative to the housing 10.

The pole 40 further includes a noncircular segment 44 formed or provided in the upper portion 45 thereof, and engaged in a corresponding noncircular and center aperture 51 of a plate 50, to allow the plate 50 to be rotated in concert with the pole 40. The pole 40 includes a bolt or a threaded portion 46 formed or provided in the upper portion 45 thereof, and threaded with such as a fastener 52, in order to solidly secure the plate 50 to the pole 40.

The fastener 52 may include a decorative contour or outer appearance for decorative purposes, and may also be used to solidly secure the plate 50 to the pole 40. The plate 50 includes a number of holes 53 formed in the lower peripheral portion thereof, and facing toward the holes 37 of the rotary member 30, and preferably aligned with the holes 37 of the rotary member 30, for rotatably receiving posts or shanks 61 of files or books 60 (FIG. 2).

Figure 2:
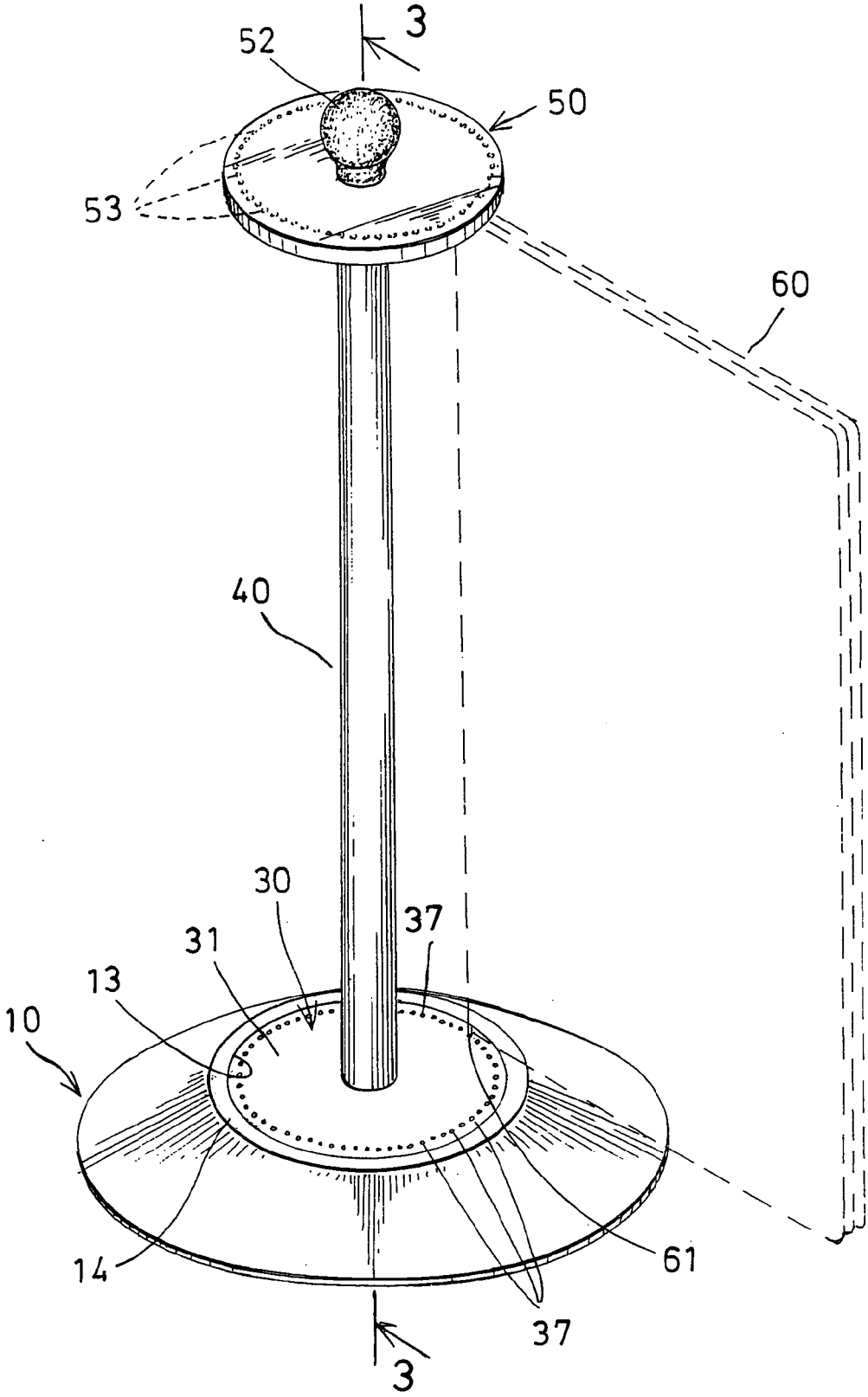
FIG. 2 is a perspective view of the rotatable book holder.

In operation, as shown in FIG. 2, the files or books 60 may be easily viewed and read by the users. In addition, the files or books 60 may also be rotated relative to the housing 10 together with the pole 40 and the rotary member 30 and the plate 50, such that the files or books 60 may further be easily viewed and read by the users.

Accordingly, the rotatable book holder in accordance with the present invention includes a rotatable support to rotatably support books and/or files therein, and for allowing the users to easily view or read the books or the files.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A book holder comprising:

a housing including a chamber formed therein, said housing including an opening formed therein and defined by a peripheral flange, a rotary member rotatably received in said chamber of said housing, and including a plurality of holes formed therein, said rotary member including a bulge extended upwardly therefrom to form a peripheral shoulder therein and to rotatable receive said peripheral flange of said housing, and to rotatably and stably secure said rotary member in said chamber of said housing, a pole including a lower portion secured to said rotary member, and including an upper portion, and a plate secured to said upper portion of said pole, and including a plurality of holes formed therein and facing toward said holes of said rotary member, for receiving shanks of books, and for allowing the books to be rotated relative to said housing in concert with said rotary member.

2. The book holder as claimed in claim 1, wherein said housing includes a weight disposed therein, to rotatably receive and support said lower portion of said pole.

3. The book holder as claimed in claim 2, wherein said weight includes a space formed therein to rotatably receive said lower portion of said pole, and a bearing received in said space of said weight and engaged onto said lower portion of said pole, to rotatably attach said pole to said weight.

4. The book holder as claimed in claim 2, wherein said housing includes a bottom board, said weight is secured on said bottom board.

5. The book holder as claimed in claim 1, wherein said rotary member includes a noncircular center aperture formed therein, said pole includes a noncircular segment provided in said lower portion thereof and engaged in said noncircular aperture of said rotary member, to allow said pole to be rotated in concert with said rotary member.

6. The book holder as claimed in claim 1, wherein said plate includes a noncircular center aperture formed therein, said pole includes a noncircular segment provided in said upper portion thereof and engaged in said noncircular aperture of said plate, to allow said plate to be rotated in concert with said pole.

7. The book holder as claimed in claim 6, wherein said pole includes a threaded portion provided on said upper portion thereof, and a fastener threaded to said threaded portion of said pole and engaged with said plate, to secure said plate to said pole.

8. A book holder comprising:

a housing including a chamber formed therein, a rotary member rotatably received in said chamber of said housing, and including a plurality of holes formed therein, said rotary member including a noncircular center aperture formed therein, a pole including a lower portion secured to said rotary member, and including an upper portion, and said pole including a noncircular segment provided in said lower portion thereof and engaged in said noncircular aperture of said rotary member, to allow said pole to be rotated in concert with said rotary member, and a plate secured to said upper portion of said pole, and including a plurality of holes formed therein and facing toward said holes of said rotary member, for receiving shanks of books, and for allowing the books to be rotated relative to said housing in concert with said rotary member, and said rotary member including a space formed therein and communicating with said aperture thereof, to receive said lower portion of said pole, and a fastener received in said space of said rotary member and threaded with said lower portion of said pole, to solidly secure said lower portion of said pole to said rotary member.

* * * * *